US009010382B2

(12) United States Patent
Matye

(10) Patent No.: US 9,010,382 B2
(45) Date of Patent: Apr. 21, 2015

(54) APPARATUS AND METHOD FOR FILLING MULTI-CHAMBER CONTAINERS WITH BULK MATERIALS

(76) Inventor: Reinhard Matye, Charlevoix, MI (US)

( * ) Notice: Subject to any disclaimer, the term of this patent is extended or adjusted under 35 U.S.C. 154(b) by 315 days.

(21) Appl. No.: 13/599,024

(22) Filed: Aug. 30, 2012

(65) Prior Publication Data

US 2013/0048148 A1 Feb. 28, 2013

Related U.S. Application Data

(60) Provisional application No. 61/528,966, filed on Aug. 30, 2011.

(51) Int. Cl.
*B65B 1/06* (2006.01)

(52) U.S. Cl.
CPC ..... *B65B 1/06* (2013.01); *B65B 2220/14* (2013.01); *B65B 2230/02* (2013.01)

(58) Field of Classification Search
USPC ..... 141/9, 83, 100, 103–104, 231–232, 141/234; 53/237, 474
See application file for complete search history.

(56) References Cited

U.S. PATENT DOCUMENTS 3,735,899 A * 5/1973 Rollinson ..... 222/135
3,867,970 A 2/1975 Winchester, Sr.
4,266,691 A * 5/1981 Wolwowicz ..... 222/77
4,378,897 A * 4/1983 Kattelmann ..... 222/56
4,594,046 A * 6/1986 Bruder et al. ..... 414/332
4,763,702 A 8/1988 High, Jr. et al.
5,121,775 A 6/1992 McClain
5,425,403 A 6/1995 Herrmann
5,535,792 A 7/1996 McGregor
5,632,449 A * 5/1997 Sandolo ..... 241/34
5,690,283 A * 11/1997 Sandolo ..... 241/34
5,957,172 A 9/1999 DeGreef et al.
5,957,331 A * 9/1999 Minor et al. ..... 222/56

(Continued)

FOREIGN PATENT DOCUMENTS

JP 07-096901 A1 4/1995

OTHER PUBLICATIONS

International Search Report and Written Opinion from corresponding Patent Cooperation Treaty Application No. PCT/US2012/053103, dated Dec. 28, 2012, which corresponds to U.S. Appl. No. 13/599,024.

(Continued)

*Primary Examiner* — Nicolas A Arnett
(74) *Attorney, Agent, or Firm* — Gardner, Linn, Burkhart & Flory, LLP

(57) ABSTRACT

An apparatus and method are provided for filling multi-chamber containers with different loose bulk materials. The apparatus and method may be particularly well-suited to packaging at least one bulk material, which is susceptible to water, chemicals, or other contaminants, with at least one other bulk material. The apparatus is a machine that includes separate hoppers for handling the separate bulk materials, and directs the separate bulk materials into different chambers of a multi-chamber container, which is then transported away from the machine for storage or use. The machine may include one or more movable hoppers supported on tracks, for moving the bulk materials to the hoppers that direct the bulk materials into different chambers of the multi-chamber container. A controller and data logger may be provided to control the apparatus and record the quantity and/or weight of the contents of each multi-chamber container.

25 Claims, 11 Drawing Sheets

(56) References Cited

U.S. PATENT DOCUMENTS

| | | | | |
|---|---|---|---|---|
| 5,979,512 | A * | 11/1999 | McGregor et al. | 141/83 |
| 6,102,088 | A | 8/2000 | Wegman | |
| 6,112,956 | A | 9/2000 | Malone | |
| 6,158,623 | A * | 12/2000 | Benavides et al. | 222/129 |
| 6,237,309 | B1 * | 5/2001 | DeMarco | 53/502 |
| 6,269,849 | B1 | 8/2001 | Fields, Jr. | |
| 6,273,153 | B1 | 8/2001 | Reinsch | |
| 6,298,984 | B1 | 10/2001 | Weaver et al. | |
| 6,474,372 | B2 | 11/2002 | Sanderson et al. | |
| 6,575,208 | B2 * | 6/2003 | Sharon et al. | 141/171 |
| 6,591,875 | B2 * | 7/2003 | Zaun et al. | 141/231 |
| 6,662,528 | B2 | 12/2003 | Holt et al. | |
| 6,776,198 | B1 * | 8/2004 | Haines et al. | 141/10 |
| 6,823,904 | B2 * | 11/2004 | Finke et al. | 141/61 |
| 6,868,650 | B2 | 3/2005 | Sanchez | |
| 6,978,812 | B2 | 12/2005 | Summerville | |
| 7,198,077 | B1 * | 4/2007 | Uzkan et al. | 141/248 |
| 8,584,714 | B2 * | 11/2013 | Gaultney | 141/83 |
| 2002/0074055 | A1 * | 6/2002 | Sanderson et al. | 141/83 |
| 2003/0062096 | A1 * | 4/2003 | Zaun et al. | 141/231 |
| 2004/0007285 | A1 * | 1/2004 | Finke et al. | 141/83 |
| 2008/0016825 | A1 | 1/2008 | Mandzsu, Sr. et al. | |
| 2010/0118640 | A1 | 5/2010 | Matye et al. | |
| 2011/0041952 | A1 * | 2/2011 | Gaultney | 141/83 |
| 2013/0056472 | A1 * | 3/2013 | Matye | 220/500 |
| 2013/0265843 | A1 * | 10/2013 | Matye | 366/8 |

OTHER PUBLICATIONS

U.S. Appl. No. 13/599,036, filed Aug. 30, 2012.

* cited by examiner

APPARATUS AND METHOD FOR FILLING MULTI-CHAMBER CONTAINERS WITH BULK MATERIALS

CROSS REFERENCE TO RELATED APPLICATION

The present application claims the benefit of U.S. provisional application Ser. No. 61/528,966, filed Aug. 30, 2011, which is hereby incorporated herein by reference in its entirety.

FIELD OF THE INVENTION

The present invention relates generally to packaging equipment, and in particular, to machinery for packaging loose bulk materials.

BACKGROUND OF THE INVENTION

Loose bulk materials such as sand, gravel, dry premix concrete, pelletized plastics, and even foodstuffs such as grains and the like, are often packaged in soft containers such as fabric bags. However, some bulk materials are not suited for storage in porous containers due to the susceptibility of the bulk materials to spoilage, chemical reactivity, or other adverse effects. For example, dry premix concrete (i.e. a dry mixture of cement binder and one or more of sand, gravel, and/or natural or man-made aggregate) cannot be stored in porous packaging materials, such as fabric or paper, unless the packages are kept in dry environments, because the cement binder component of the premix concrete can react with environmental moisture and harden prematurely.

SUMMARY OF THE INVENTION

The machine or apparatus of the present invention is a filling machine configured to fill multi-chamber containers with two or more different bulk materials. Generally, at least one of the bulk materials is to be kept in isolation from the other bulk material(s) and/or in isolation from environmental elements such as rainwater and/or other chemicals or contaminants. The filling machine thus provides for separate filling of separate chambers of a container so that the different bulk materials are isolated from one another throughout the filling process. Thus, any bulk materials that are susceptible to exposure to moisture or other elements or contaminants may be loaded into multi-chamber containers, substantially without risk of exposing at least one of the bulk materials to potentially harmful substances or materials.

According to one form of the present invention, a filling machine for filling multi-chamber containers with two or more different materials includes a frame and first and second elevated hoppers. The frame supports the hoppers at elevated positions, where the first and second elevated hoppers are configured to contain a first bulk material and a second bulk material, respectively. The first elevated hopper includes a corresponding first dispensing portion and the second elevated hopper includes a corresponding second dispensing portion. The first and second dispensing portions are configured to dispense the first and second bulk materials from the first and second elevated hoppers, respectively. The first elevated hopper dispenses the first bulk material into a first chamber of the container via the first dispensing portion, and the second elevated hopper dispenses the second bulk material into a second chamber of the container via the second dispensing portion. Optionally, the first and second bulk materials are different from one another in composition.

In one aspect, at least one of the first and second dispensing portions of the filling machine includes an actuatable member that selectively permits at least one of the first and second bulk materials to flow through the respective dispensing portion. Optionally, the actuatable member may be a pneumatically or hydraulically actuated slide gate.

In another aspect, the actuatable member includes a measurement device for measuring the quantity of the first or second bulk materials as they are dispensed through the respective first or second dispensing portion of the filling machine.

In yet another aspect, the filling machine includes a data recorder for recording the quantity (e.g., measured by volume or weight) of at least one of the first and second bulk materials that has been dispensed into at least one of the chambers of the multi-chamber containers. Optionally, the data recorder includes a printer for creating a written record of the quantity of at least one of the bulk materials that has been dispensed into at least one chamber of the multi-chamber container.

In still another aspect, the first bulk material is a cement binder and the second bulk material is a mixture of sand and aggregate.

In another aspect, the filling machine further includes a supply hopper and a supply conveyor coupled between the supply hopper and the second elevated hopper. The supply hopper contains the second bulk material and is spaced laterally away from the second elevated hopper. The supply conveyor conveys the second bulk material from the supply hopper to the second elevated hopper. Optionally, the supply hopper is positioned at an elevation below that of the second elevated hopper.

In still another aspect, the first elevated hopper receives the first bulk material from a pneumatically-driven supply tube in which the first bulk material is fluidized and pumped from a supply source into the first elevated hopper via the pneumatically-driven supply tube.

In another aspect, the filling machine includes a third elevated hopper at the frame for containing a third bulk material which is different in composition than the first and second bulk materials. The third elevated hopper includes a third dispensing portion for dispensing the third bulk material, which it dispenses into the second chamber of the multi-chamber container via the third dispensing portion. Optionally, according to this aspect, the first bulk material may be a cement binder or the like, the second bulk material may be aggregate or the like, and the third bulk material may be sand or the like. A second supply hopper and second supply conveyor may be provided to supply and direct the third bulk material into the third elevated hopper.

In a further aspect, the filling machine includes a conveyor for transporting filled containers away from a filling station or region of the machine. Optionally, at least a portion of the conveyor is positioned below the first and second elevated hoppers.

In another aspect, the filling machine further includes a first supply hopper movably supported on a first support track, and a first drive mechanism for moving the first supply hopper along the track. The first supply hopper contains and transports the second bulk material, and has a dispensing portion for selectively dispensing the second bulk material into the second container-filling hopper. The first support track has a first end portion spaced laterally away from the second container-filling hopper, and a second end portion positioned above the second container-filling hopper. The first drive mechanism is operable to move the first supply hopper between the first and second end portions of the first support track. Optionally, the first supply hopper includes at least one wheel for rolling engagement with the first support track. Optionally, the first drive mechanism is a cable winch.

In yet another aspect, the filling machine includes an actuatable member at the dispensing portion of the first supply hopper. The actuatable member is operable to selectively permit the second bulk material to be dispensed through the dispensing portion of the first supply hopper when the first supply hopper is positioned at the second end portion of the first support track. Optionally, the actuatable member is operable in response to a pressurized fluid, while the filling machine further includes a pressurized fluid source, a pressurized fluid hose in fluid communication with the fluid source and the actuatable member, and a hose reel for extending and retracting the fluid hose. The hose reel is operable to extend and retract the pressurized fluid hose as the first supply hopper is moved between the first and second end portions of the first support track by the first drive mechanism.

In still another aspect, a third hopper is supported at the frame and is configured to contain a third bulk material, the third bulk material being different in composition than the first and second bulk materials. The third hopper is in fluid communication with a corresponding third dispensing portion, and the third dispensing portion is operable to dispense the third bulk materials from the third hopper and into the second chamber of the multi-chamber container.

In still another aspect, the filling machine further includes a second supply hopper for containing the third bulk material, the second supply hopper having a dispensing portion for selectively dispensing the third bulk material. The second supply hopper is movably supported at a second support track, which has a first end portion spaced laterally away from the third hopper and a second end portion positioned above the third hopper. A second drive mechanism is operable to move the second supply hopper between the first and second end portions of the second support track.

Optionally, the filling machine may include a screw conveyor for conveying the first bulk material to the first container-filling hopper.

Optionally, the first bulk material is a cement binder, the second bulk material is sand, and the third bulk material is gravel or aggregate.

In yet another aspect, the filling machine includes a first funnel positioned above the first end portion of the first support track and, when the first supply hopper is positioned at the first end portion of the first support track, the first funnel is also positioned above the first supply hopper. The first funnel is configured to direct the second bulk material from a second bulk material source into the first supply hopper at the first end portion of the first support track.

Optionally, the first funnel is a pivotable funnel that is movable between a lowered position for directing the first bulk material from the source into the first supply hopper, and a raised position that allows the first supply hopper to move toward the second end portion of the first support track.

In a further aspect, the filling machine includes an interlock mechanism for inhibiting the first drive mechanism from moving the first supply hopper toward the second end portion of the first support track when the first funnel is in the lowered position.

In a still further aspect, the filling machine includes a second pivotable funnel and a second interlock mechanism. In a manner similar to the first pivotable funnel, the second pivotable funnel is positioned above the first end portion of the second support track, and the second pivotable funnel is also positioned above the second supply hopper when the second supply hopper is positioned at the first end portion of the second support track. The second pivotable funnel is configured to direct the third bulk material from a third bulk material source into the second supply hopper at the first end portion of the second support track. The second pivotable funnel is movable between a lowered position for directing the third bulk material from the other source into the second supply hopper, and a raised position for allowing the second supply hopper to move toward the second end portion of the second support track. A second interlock mechanism may be provided to inhibit the second drive mechanism from moving the second supply hopper toward the second end portion of the second support track when the second funnel is in the lowered position.

In still another form of the present invention, a filling machine for filling multi-chamber containers with two or more different bulk materials includes a frame, first and second container-filling hoppers supported by the frame, a supply hopper, a support track, and a drive mechanism. The first and second container-filling hoppers contain a first bulk material and a second bulk material, respectively, the second bulk material being different in composition than the first bulk material. The first container-filling hopper is in fluid communication with a corresponding first dispensing portion and the second container-filling hopper is in fluid communication with a corresponding second dispensing portion. The first and second dispensing portions dispense the first and second bulk materials from the first and second container-filling hoppers, respectively. The first container-filling hopper is configured to dispense the first bulk material into a first chamber of a multi-chamber container via the first dispensing portion and the second container-filling hopper is configured to dispense the second bulk material into a second chamber of the multi-chamber container via the second dispensing portion. The supply hopper contains and transports the second bulk material, and supplies it to the second container-filling hopper for further dispensing into the second chamber of the multi-chamber container. The supply hopper has a dispensing portion that allows it to selectively dispense the second bulk material into the second container-filling hopper. The support track movably supports the supply hopper and includes a first end portion spaced laterally away from the second container-filling hopper, and a second end portion positioned above the second container-filling hopper. The drive mechanism is associated with the support track and is configured to move the supply hopper between the first and second end portions of the support track.

In another form of the present invention, a method is provided for filling multi-chamber containers with two or more different bulk materials. The method includes providing a filling machine having a frame, first and second container-filling hoppers supported at the frame, and a conveyor. The first container-filling hopper is filled with a first bulk material and the second container-filling hopper is filled with the second bulk material. A multi-chamber container is positioned at a filling station of the filling machine. A predetermined amount of the first bulk material is dispensed into a first chamber of the multi-chamber container via a first dispensing portion, which is associated and in fluid communication with the first container-filling hopper. Similarly, a predetermined amount of the second bulk material is dispensed into a second chamber of a multi-chamber container via a second dispensing portion that is associated and in fluid communication with the second container-filling hopper. The filled multi-chamber container is then transported away from the filling station with the conveyor.

In one aspect, data indicative of the contents and/or the weight of the filled multi-chamber container is measured and recorded, and optionally, may be printed on a label or transmitted as an electronic signal.

In another aspect, at least one of the first and second container-filling hoppers is supplied with the first or second bulk material by at least one supply hopper and a corresponding supply conveyor.

In yet another aspect, at least one of the first and second container-filling hoppers is supplied with the first or second bulk materials in fluidized form by at least one pneumatic tube.

In still another form of the present invention, another method is provided for filling multi-chamber containers with two or more different bulk materials. The method includes providing a filling machine having a frame and first and second container-filling hoppers supported at the frame, and providing a movable hopper coupled to a support track having a first end portion and a second end portion. The first end portion of the support track is positioned above the second container-filling hopper. The first container-filling hopper is filled with a first bulk material. The movable hopper is positioned at the second end portion of the support track and then filled with the second bulk material. The movable hopper is then moved to the first end portion of the support track. The second bulk material is then dispensed from the movable hopper into the second container-filling hopper. A multi-chamber container is positioned below the first and second container-filling hoppers of the filling machine. A predetermined amount of the first bulk material is dispensed into a first chamber of the multi-chamber container via a first dispensing portion in fluid communication with the first container-filling hopper, and a predetermined amount of the second bulk material is dispensed into a second chamber of the multi-chamber container via a second dispensing portion in fluid communication with the second container-filling hopper. The multi-chamber container is then transported away from the filling station.

Thus, the present invention provides a filling machine and method for filling multi-chamber containers in such a manner that at least two different bulk materials may be dispensed separately and/or simultaneously into separate chambers of a given container. The machine may also include a conveyor for transporting filled containers away from the filling location, and may further include a weight scale and data recording capabilities to record and/or display pertinent information (e.g., weight and composition) of the contents of each filled container. The machine may be supported on a portable frame, and may be configured for transportation along roadways.

These and other objects, advantages, purposes, and features of the present invention will become apparent upon review of the following specification in conjunction with the drawings.

DESCRIPTION OF THE PREFERRED EMBODIMENTS

The present invention is directed to a filling machine for bulk material containers that are configured to hold two or more separate bulk materials in separate chambers of the containers, and to a method of filling such containers. While the present invention is primarily described for use in filling containers having two distinct chambers, it should be understood that the same or similar principles may be used for filling other multi-chamber containers without departing from the spirit and scope of the present invention.

Figure 1:
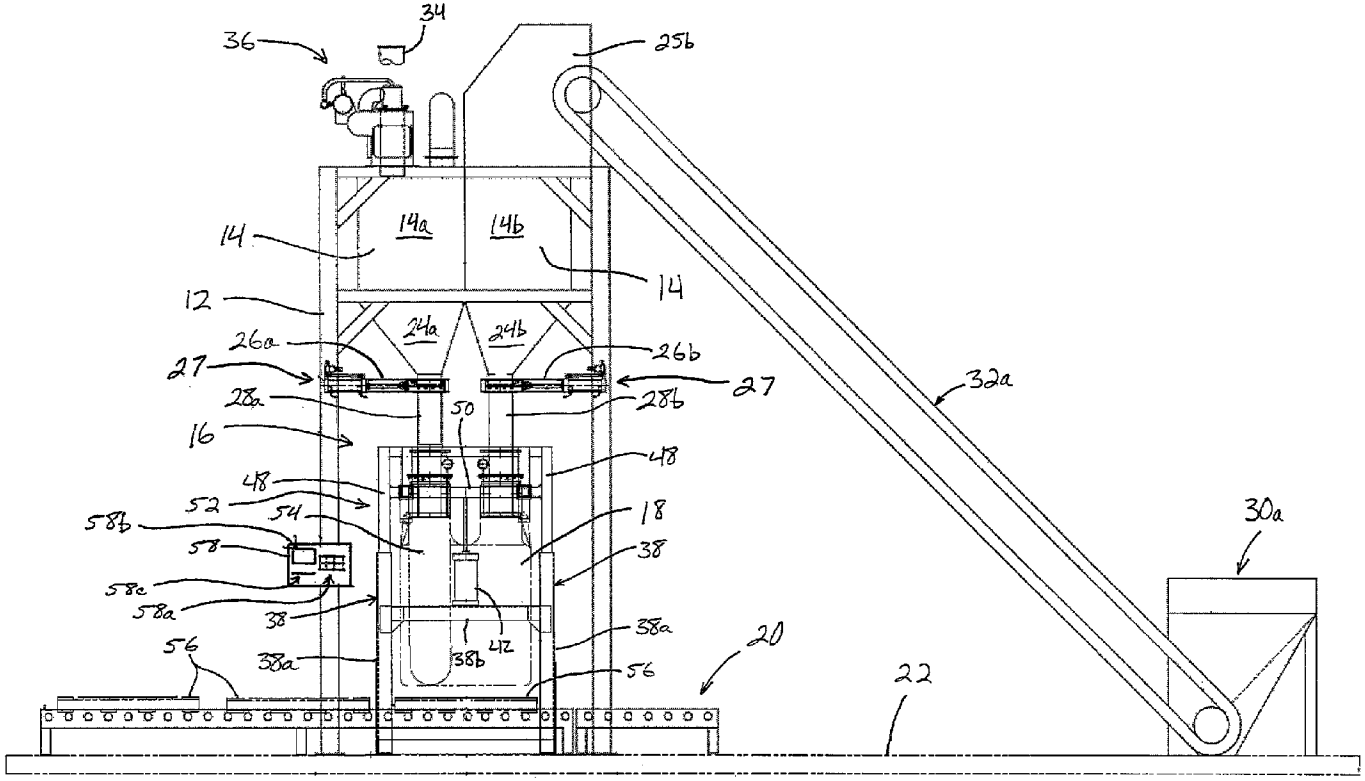
FIG. 1 is a side and partial cutaway elevation of a filling machine in accordance with the present invention.

Referring now to FIG. 1, a filling machine 10 includes a framework 12 supporting a plurality of elevated hoppers 14 above a container-filling station 16 where containers such as multi-chamber containers 18 are filled with bulk materials received from elevated hoppers 14. A conveyor system 20 is provided for receiving and transporting filled containers 18 away from container-filling station 16. Filling machine 10 is supported on a support surface 22, such as the ground or a concrete slab or the like. Optionally, filling machine 10 may be readily portable on a trailer frame (or may include provisions, such as wheels, suspension, and a drawbar, for transporting the machine without a separate trailer frame), and configured for at least partial disassembly and transport to work sites, production sites, or storage locations.

Elevated hoppers 14 include a first elevated hopper 14*a* for containing a first bulk material, a second elevated hopper 14*b* for containing a second bulk material, and a third elevated hopper 14*c* for containing a third bulk material. In the illustrated embodiment, elevated hoppers 14 are substantially conventional and configured for containing the loose bulk material components of concrete, including cement binder as the first bulk material, aggregate or gravel as the second bulk material, and sand as the third bulk material. Second and third elevated hoppers 14*b*, 14*c* may be open-topped hoppers that are open to the elements, and may be suitable for storing and dispensing second and third bulk materials that are not particularly susceptible to moisture or other contamination, or to being dispersed in high winds. First elevated hopper 14*ah* may be fully enclosed to protect the first bulk material from contamination or dispersion by wind.

In the illustrated embodiment, first elevated hopper 14*a* has a capacity of approximately 94 cubic feet, while each of second and third elevated hoppers 14*b*, 14*c* are approximately 42 cubic feet in capacity. However, it will be appreciated that the elevated hoppers can be substantially any size desired for a particular application, which need not be limited to the component bulk materials of concrete. For example, the filling machine 10 could be configured to handle any number of bulk materials, such as grains, pelletized plastics, granular compositions or chemicals, or substantially any fluid or fluidizable material, without departing from the spirit and scope of the present invention.

Each elevated hopper 14 is in fluid communication with a corresponding dispensing portion, such as first, second, and third dispensing portions 24*a-c*, which are generally in the form of tapered, funnel-shaped members in fluid communication with respective ones of elevated hoppers 14*a-c*. Elevated hoppers 14*b*, 14*c* include respective shrouds 25*b*, 25*c* to limit dust and dispersion of the second and third bulk materials. Elevated hoppers 14 are supported at an upper end portion of framework 12, which itself is supported at its lower end by support surface 22.

Dispensing portions 24*a-c* are equipped with respective actuatable members 26*a-c* in the form of pneumatic slide gates supported at framework 12 and positioned at the lower portions of the respective dispensing portions 24*a-c*. Portions of actuatable members 26*a-c* function substantially as valves that are operable between open and closed configurations for selectively controlling the flow of bulk materials through each respective dispensing portion 24*a-c*. Each actuatable member 26*a-c* may be independently controllable to meter or regulate the quantity of bulk materials dispensed out of each of the elevated hoppers 14*a-c*. Measurement devices 27 (FIG. 1), such as timers or flow-measuring devices, may be provided for measuring the quantity of bulk materials dispensed out of each of the elevated hoppers 14*a-c* and for actuating the actuatable members 26*a-c* accordingly. Suitable actuatable members in the form of pneumatic slide gates are available, for example, from DCL, Inc. of Charlevoix, Mich. When actuatable members 26*a-c* are in the their respective open configurations, dispensing portions 24*a-c* are in fluid communication with respective conduits or tubes 28*a-c*, which direct the respective bulk materials toward container-filling station 16. Optionally, the actuatable members 26*a-c* may be disposed substantially anywhere along tubes 28*a-c* to control the flow of bulk materials out of elevated hoppers 14*a-c*.

In the illustrated embodiment, second and third elevated hoppers 14*b*, 14*c* are supplied with their respective second and third bulk materials from first and second ground-supported supply hoppers 30*a*, 30*b*. The second bulk material is directed from the first supply hopper 30*a* via a first conveyor 32*a*, while the third bulk material is conveyed from the second supply hopper 30*b* to the third elevated hopper 14*c* by a second supply conveyor 32*b*. Supply hoppers 30*a*, 30*b* may be conventional bulk material hoppers having open top portions to facilitate loading from a ground-supported truck, trailer, or other vehicle. For example, suitable supply hoppers are available from DCL, Inc. of Charlevoix, Mich., Supply conveyors 32*a*, 32*b* are also substantially conventional powered conveyors for moving loose bulk materials from supply hoppers 30*a*, 30*b* to elevated hoppers 14*b*, 14*c*. Supply conveyors 32*a*, 32*b* may be electrically powered paddle-type conveyors, with lower end portions disposed inside of lower end portions of the respective supply hoppers 30*a*, 30*b*, and with upper end portions terminating above the respective second and third elevated hoppers 14*b*, 14*c* and/or the corresponding shrouds 25*b*, 25*c*. For example, suitable supply conveyors are available from DCL, Inc. of Charlevoix, Mich.

Figure 3:
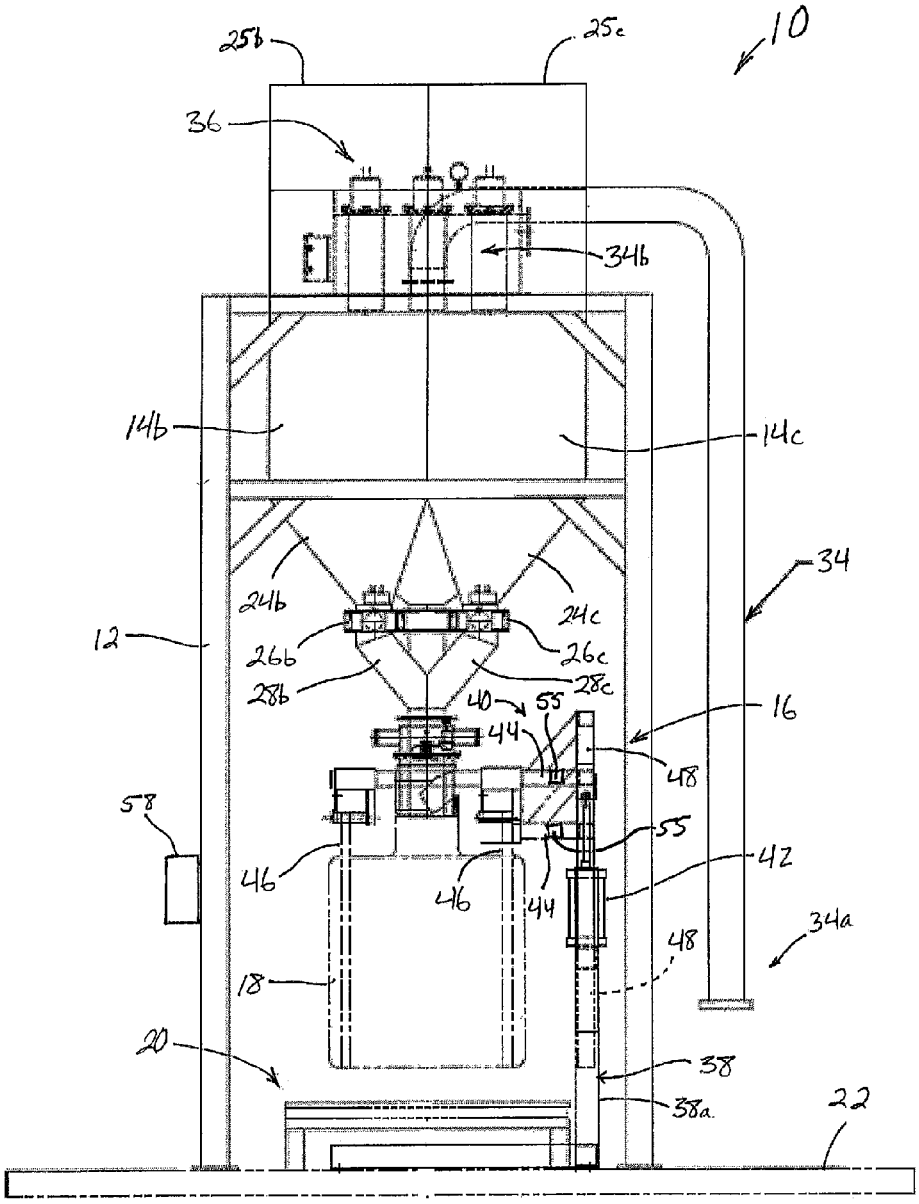
FIG. 3 is an end elevation and partial cutaway view of the filling machine of FIG. 1, and showing the support arms of the filling station at both raised and lowered positions.

When at least one of the bulk materials handled by filling machine 10 is susceptible to moisture, contamination, or even to being dispersed by wind, it may be particularly desirable to provide a pneumatic tube 34 in which bulk materials are fluidized (i.e. agitated sufficiently to flow substantially as a fluid) and driven pneumatically by air flow through the tube from a supply source such as a truck, trailer, or other vehicle equipped with a supply of compressed air. Pneumatic tube 34 has an inlet end portion 34*a* spaced above support surface 22, and an outlet end 34*b* positioned above first elevated hopper 14*a* (FIG. 3). Outlet end portion 34*b* of pneumatic tube 34 passes through or into a separator, such as a passive inline ventilation module 36, which is supported at the upper portion of framework 12. Ventilation module 36 separates the compressed air in the pneumatic tube 34 from the first bulk material in the pneumatic tube 34, venting the air and allowing the first bulk material to be discharged into first elevated hopper 14*a*. For example, a suitable passive inline ventilation module is available as Model VML140 from DCL, Inc. of Charlevoix, Mich.

By directing the first bulk material from a supply source, such as a vehicle or the like, through the enclosed pneumatic tube 34 and directly into the first elevated hopper 14*a*, which may be fully enclosed to protect the first bulk material from contamination, the first bulk material is protected from contact with moisture or other chemicals or contaminants as it is conveyed through filling machine 10, and is generally not susceptible to being dispersed by wind that may be present in the vicinity of filling machine 10. This may be particularly desirable when the first bulk material is susceptible to moisture or other elements, such as when the first bulk material comprises a water-activated cement binder or the like. It will be appreciated that, alternatively, another supply hopper and supply conveyor substantially similar to hoppers 30*a*, 30*b* and conveyors 32*a*, 32*b*, may be used instead of pneumatic tube 34 to supply the first bulk material to first elevated hopper 14*a*, particularly if the first bulk material is not susceptible to contamination from outside sources.

Container-filling station 16 includes a container-supporting framework 38 to which is mounted a container supporting/lowering mechanism 40, as best shown in FIG. 3. Container-supporting/lowering mechanism 40 includes a piston-cylinder device 42 for raising and lowering a set of container-supporting arms 44 that receive and support container straps 46 that extend above the multi-chamber container 18 so that the container 18 may be suspended from container-supporting arms 44 of mechanism 40. Multi-chamber container 18 may be substantially similar to that described in a co-pending and commonly-assigned U.S. Publication No. 2013/0056472 entitled MULTI-CHAMBER CONTAINER FOR BULK MATERIALS, which claims the priority benefit of U.S. provisional application Ser. No. 61/528,958, filed Aug. 30, 2011, which are hereby incorporated herein by reference in their entireties. Container-supporting arms 44 pass through loops formed by container straps 46, and are coupled to vertical support members 48 that are telescopingly disposed inside of corresponding vertical members 38*a* of container-supporting framework 38. Piston-cylinder device 42 is coupled at one end to a cross member 38*b* (FIG. 1) of container-supporting framework 38, and at an opposite end to a cross member 50 that spans between spaced vertical support members 48. Piston cylinder device 42 is supplied with compressed air or hydraulic fluid to raise vertical support members 48, container-supporting arms 44, and cross member 50 relative to container-supporting framework 38.

Container-filling station 16 further includes a bag-sealing device 52 that is configured to close and seal the top portion of a secondary bag or liner 54 disposed within the multi-chamber container 18. Bag-sealing device 52 may be configured to close and seal an open top portion of secondary bag 54, such as by heat-sealing, gluing, ultrasonic welding, or the like. Alternatively, the bag sealing device may close a zipper or other form of interlocking device along the top of the secondary bag 54 in order to close and/or seal the secondary bag.

Container 18 is filled with bulk materials while container-supporting/lowering mechanism is at an elevated position so that tubes 28*a-c* are positioned inside or above the open top ends of container 18 and secondary bag 54 to direct the different bulk materials directly into the desired portions or chambers of the container. After the container is filled, the piston-cylinder device 42 is actuated to lower the container-supporting arms 44 until the container 18 rests upon conveyor system 20. Optionally, the container-supporting arms may be equipped with release mechanisms to drop or release the containers onto the conveyor after the containers are filled. Container-supporting arms 44 may include a legal-for-trade weigh scale device 55 (FIG. 3) capable of weighing the contents of container 18 and sending a data signal to a data recorder, as will be described in greater detail below. Optionally, a weigh scale could be incorporated or installed at the conveyor system 20 or at the piston-cylinder device 42, such as between the piston-cylinder device 42 and cross member 38*b* or cross member 50.

Conveyor system 20 may be a roller conveyor, as shown, or it may be a belt conveyor or an overhead rail-type conveyor for supporting and transporting the containers 18 away from container-filling station 16. When conveyor system 20 is configured as a roller conveyor, it may be desirable to provide individual pallets 56 for supporting individual containers 18 upon the conveyor 20 such as shown in FIG. 1. Once containers 18 have been conveyed away from container-filling station 16 along conveyor system 20, the filled containers 18 may be carried away on pallets 56, such as by a fork lift, or the containers may be picked up and suspended by their container straps 46 for conveying away from filling machine 10. Once containers 18 are removed from conveyor system 20, they may be placed into storage or put into use, such as described in copending, commonly-assigned U.S. Publication No. 2010/0118640 entitled "MOBILE CONCRETE MIXING PLANT," which is hereby incorporated herein by reference in its entirety.

Figure 2:
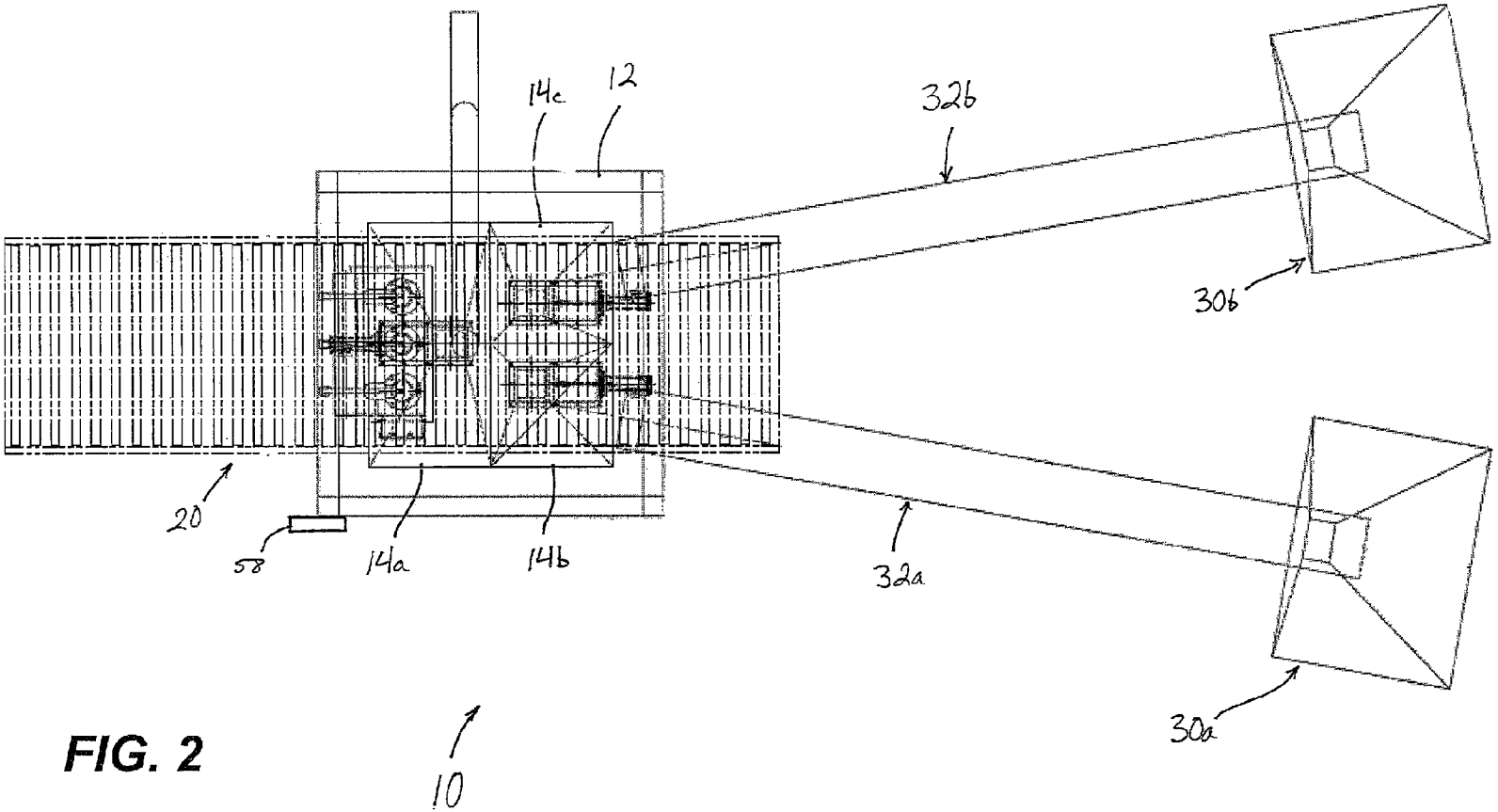
FIG. 2 is a top plan and partial cutaway view of the filling machine of FIG. 1.

In the illustrated embodiment, filling machine 10 includes a data recorder and controller 58 (FIGS. 1-3) for controlling the operation of the filling machine 10, and for recording data about the contents of each container 18. For example, data recorder and controller 58 may be configured to control the actuation of piston-cylinder device 42 to raise and lower container-supporting arms 44, and to operate actuatable members 26*a-c* to meter specific quantities of bulk materials from the elevated hoppers 14*a-c* into the chambers of container 18. Data recorder and controller 58 may receive data pertaining to the contents of each container 18, including the amount and/or weight ratio of each bulk material that has been added to each container, and the container's final weight as reported by the weigh scale. Optionally, the amount of each bulk material may be expressed in terms of weight, volume, or other measurable criteria (e.g., mole), and the ratio of one material to another may be expressed in terms of weight ratio, volume ratio, molar ratio (such as for chemical compounds), or the like.

Data recorder and controller 58 may be substantially any electronic or electrical device capable of carrying out control algorithms, such as in a computer or microprocessor, and may include a control input device 58*a* (such as a key pad or a touch screen or the like), a display 58*b*, and a printer 58*c* or other data output device (FIG. 1). Thus, data recorder and controller 58 is operable to control some or all of the functions of filling machine 10 including operation of supply conveyors 32*a*, 32*b*, operation of passive inline ventilation module 36, operation of actuatable members 26*a-c*, operation of container-filling station 16 including piston cylinder device 42 and bag-sealing device 52, and operation of conveyor system 20. Data recorder and controller 58 is further operable to record and transfer or print data pertaining to the contents of containers 18. Data recorder and controller 58 may be pre-programmed to fill containers 18 with predetermined quantities of bulk materials such that an operator using the data recorder and controller 58 may simply select a desired composition for the contents of containers 18 and permit the data recorder and controller 58 to control the various components of the filling machine 10 (particularly actuatable members 26*a-c*) during its operation to achieve the desired results. Printer 58*c* may be used to output a printed record of the contents of each container 18, which can be affixed to each container 18 for ease of reference prior to use of the container contents.

Accordingly, filling machine 10 provides a substantially self-contained container-filling facility for multi-chamber bags or containers, which is readily transported to a convenient location and is operable to provide a substantially constant supply of filled containers containing two or more different materials, such as for later mixing and use. Filling machine 10 is positioned at a support surface 22 and is erected with its framework 12 supporting elevated hoppers 14 and their associated devices and components. Container-filling station 16 is positioned below the elevated hoppers 14, the conveyor system 20 is arranged to receive containers from the container-filling station and convey them away from the station 16, and ground-supported supply hoppers 30*a*, 30*b* and supply conveyors 32*a*, 32*b* are arranged to supply bulk materials to elevated hoppers 14*b*, 14*c*. Pneumatic tube 34 is arranged to receive and direct the first bulk material into first elevated hopper 14*a* via passive inline ventilation module 36. Filling machine 10 may be supplied with electrical power and/or pressurized hydraulic fluid and/or pressurized air from one or more outside sources for powering and controlling the various devices of the filling machine, or may be equipped with its own electrical generating device and/or fluid pressurizing devices (not shown) so that the filling machine 10 is fully self-contained.

Once the filling machine 10 is erected, second and third elevated hoppers 14*b*, 14*c* are filled with the second and third bulk materials via first and second supply conveyors 32*a*, 32*b* directing the bulk materials from the first and second ground-supported supply hoppers 30*a*, 30*b*. The first elevated hopper 14*a* is supplied with the first bulk material via pneumatic tube 34. Actuatable members 26*a-c* are initially set in their closed configurations to prevent the bulk materials from flowing out of the elevated hoppers 14*a-c* until such flow is desired. A supply of multi-chamber containers 18 is made readily available at container-filling station 16, with the containers being loaded one at a time into container-filling station 16 and supported by container-supporting arms 44. Piston-cylinder device 42 is extended to raise container-supporting arms 44 so that tubes 28*a-c* extend into or are positioned above the open upper ends of the individual chambers of the multi-chamber container 18.

An operator selects a desired mixture ratio for the contents of container 18 at data recorder and controller 58 (such as via controller input 58*a*) and initiates a sequence that fills, seals, and conveys the container 18 away from filling station 16. Actuatable members 26*a-c* are set at their open configurations until a predetermined amount of each bulk material is dispensed from each elevated hopper 14*a-c* through corresponding dispensing portions 24*a-c*, through corresponding tubes 28*a-c*, and into the container 18, with the first bulk material from first elevated hopper 14*a* being dispensed into secondary bag 54, which is positioned inside of container 18.

Actuatable members 26*a-c* are once again closed after a desired amount of bulk materials have been dispensed, and bag-sealing device 52 is then operated to close and seal the upper end portion or neck of secondary bag 54.

Once the container 18 is filled and the secondary bag 54 is closed and sealed, piston-cylinder device 42 is actuated to lower the container-supporting arms 44 and container 18 until the container is supported on a pallet 56 on conveyor system 20, the pallet 56 being located directly below the container 18. Alternatively, container-filling station 16 may simply drop each container 18 once the container has been filled, rather than lowering the container as shown. The filled container 18 is then conveyed away from container-filling station 16 on conveyor system 20, after which the filled container 18 is removed from the conveyor system 20 and an empty container is loaded onto container-supporting arms 44 to repeat the process. Optionally, a data printout from printer 58*c* is affixed to each filled container 18 after it has been filled. Data recorder and controller 58 may also create an electronic log of the contents of each container for recordkeeping purposes.

Optionally, the data recorder and controller 58 permits substantially automated operation of the filling machine 10, although it will be understood that the machine 10 may be at least partly controlled by an operator, or may be fully manually operated, without departing from the spirit and scope of the present invention. In addition, container-filling station 16 may be configured to receive a supply of empty containers for automatically loading an empty container onto container-supporting arms 44 after each preceding container has been filled. Filling machine 10 may be operated substantially continuously when provided with a continuous supply of bulk materials and containers.

Figure 4:
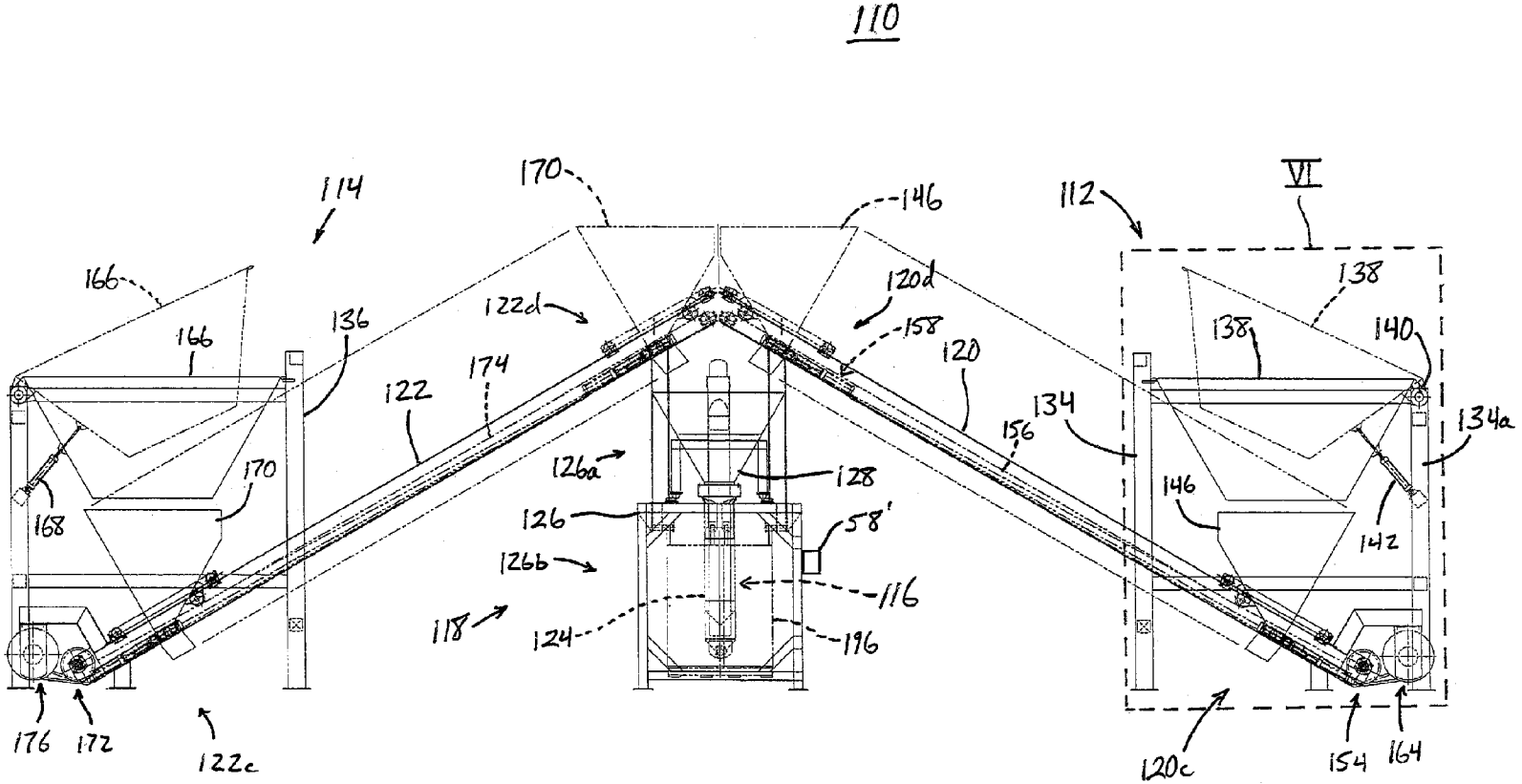
FIG. 4 is a side elevation of another filling machine in accordance with the present invention.
Figure 5:
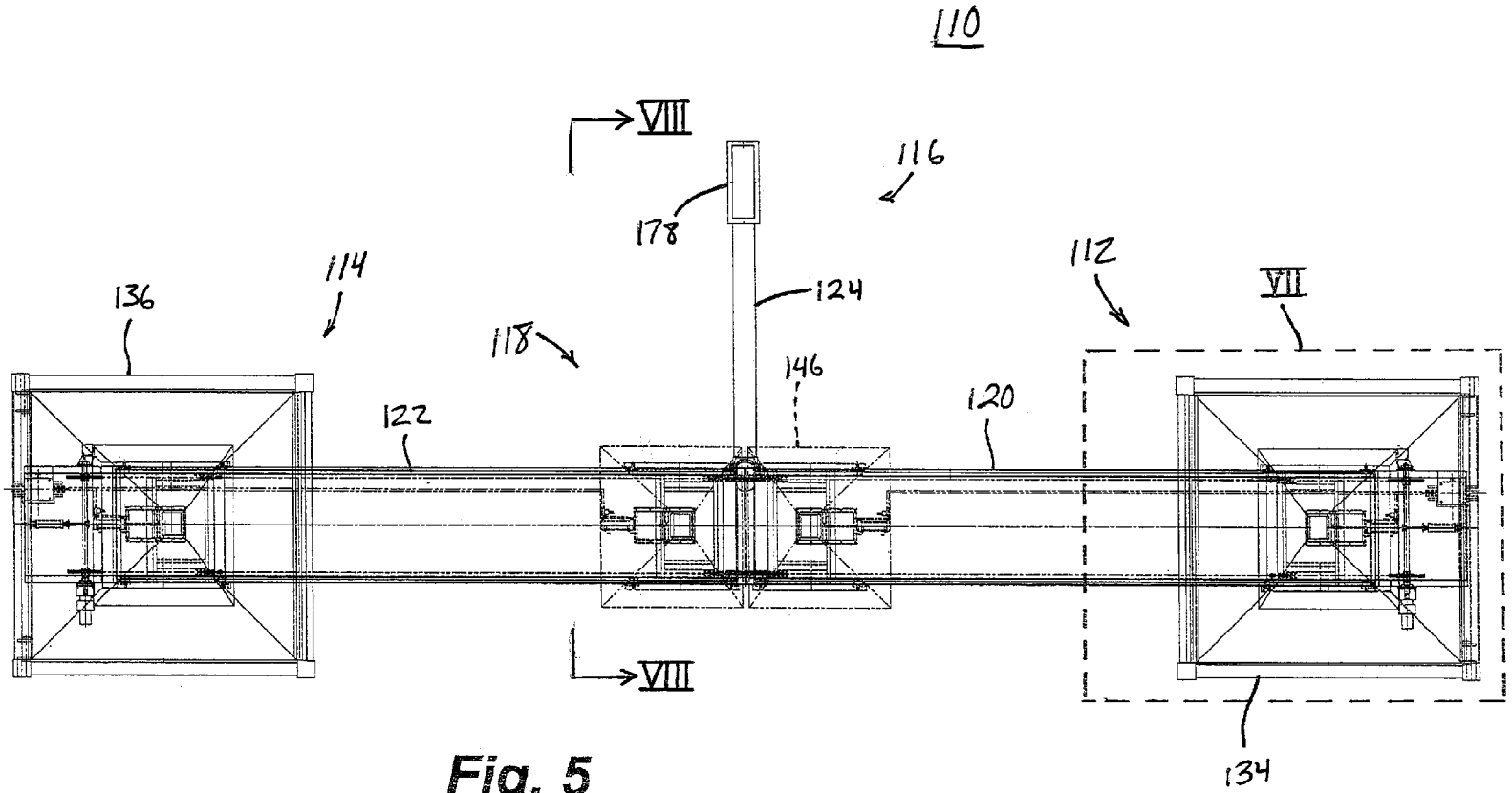
FIG. 5 is a top plan view of the filling machine of FIG. 4.

Optionally, and with reference to FIGS. 4 and 5, another bag-filling machine 110 includes a sand-loading station 112, and aggregate-loading station 114, a cement-loading station 116, and a container-filling station 118. Each of sand-loading station 112, aggregate-loading station 114, and cement-loading station 116 is coupled to container-filling station 118, or is at least capable of transporting respective bulk materials to container-filling station 118. Sand-loading station 112 is coupled to container-filling station 118 via a first support track 120, aggregate-loading station 114 is coupled to container-filling station 118 via a second support track 122, and cement-loading station 116 directs cement to container-filling station 118 via a screw conveyor 124.

Container-filling station 118 includes a framework 126 having an upper end portion 126*a* and a lower end portion 126*b* (FIG. 4). Upper end portion 126*a* of framework 126 supports a container-filling cement-dispensing hopper 128 that receives bulk cement from cement-loading station 116 via screw conveyor 124. Upper end portion 126*a* further supports a container-filling hopper 130 (not shown in FIG. 4). Container-filling hopper 130 receives bulk sand from sand-loading station 112, and also receives bulk aggregate from aggregate-loading station 114, as will be described below.

Figure 6:
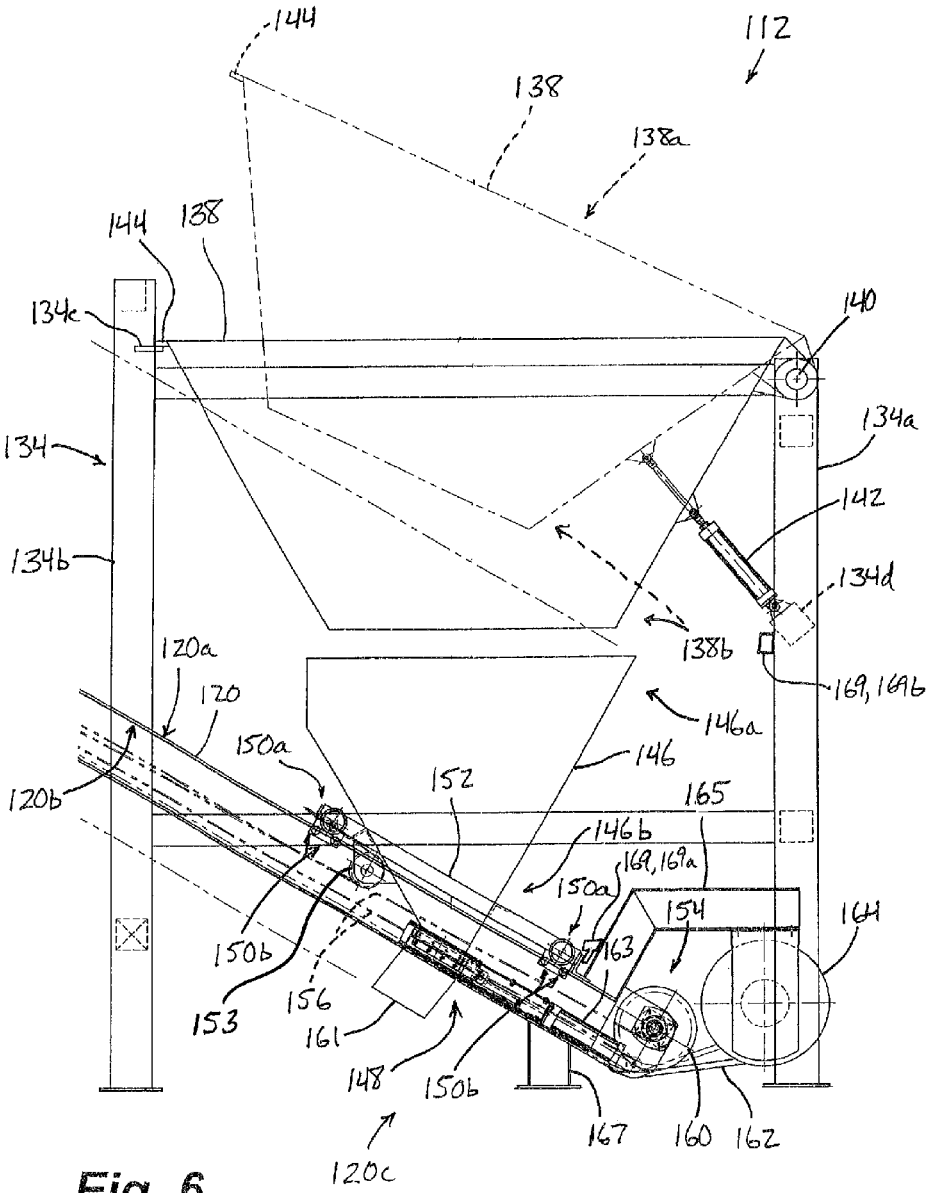
FIG. 6 is an enlarged view of the area designated VI in FIG. 4.

Sand-loading station 112 includes a framework 134, and aggregate-loading station 114 likewise also includes a framework 136. Sand-loading station 112 includes a pivotable funnel 138 that is coupled to framework 134 via a hinge or pivot 140 at the upper end of an outboard vertical frame member 134*a*, and an actuator 142 coupled between funnel 138 and outboard vertical frame member 134*a*, below pivot 140 (FIG. 6). Optionally, pivotable funnel 138 includes a generally horizontal lip or projection 144 that extends from an upper portion 138*a* of pivotable funnel 138, opposite pivot 140, and which rests atop a cross-member 134*c* that is supported between a pair of inboard vertical frame members 134*b*.

Actuator 142, which may be a single-acting or double-acting piston-cylinder actuator, such as an electric, hydraulic, or pneumatic actuator, or other type of linear actuator, is mounted to another cross member 134*d* of framework 134, coupled between outboard vertical frame members 134*a*. Actuator 142 is extendable and retractable between extended and retracted positions, such as shown in FIG. 6, in which the extended position is shown in dashed lines. When actuator 142 is in the extended position, funnel 138 is pivoted upwardly (also shown in dashed lines in FIG. 6), and when actuator 142 is retracted, funnel 138 is at a lowered position with lip 144 resting atop cross member 134*c*. Optionally, a rotary actuator may be incorporated at pivot 140 for moving the funnel between its raised and lowered positions.

A movable supply hopper 146 is supported by first support track 120, and is movable along first support track 120 between a lower position (FIGS. 4 and 6) and a raised position (FIG. 4, in dashed lines). Supply hopper 146 includes an upper end portion 146*a* and a lower end portion 146*b*. Supply hopper 146 is generally funnel-shaped, with upper end portion 146*a* defining an open mouth having generally larger dimensions than lower end portion 138*b* of funnel 138, which limits or prevents the spilling of bulk sand as it is loaded into supply hopper 146 via pivotable funnel 138. Lower end portion 146*b* of supply hopper 146 is narrower than upper end portion 146*a*, and includes a dispensing portion 148 with a movable slide-gate or the like, for selectively dispensing the bulk sand from supply hopper 146, as will be described below.

Supply hopper 146 is movably supported on first support track 120 via a plurality of wheels including upper wheels 150*a* and at least one lower wheel 150*b*, which are rotatably coupled to a carriage 152 at lower end portion 146*b* of supply hopper 146. Upper wheels 150*a* roll along an upper track surface 120*a* of first support track 120, while lower wheels 150*b* roll along a lower track surface 120*b*. Optionally, lower wheels 150*b* are spaced slightly from lower track surface 120*b*, and only contact the lower track surface 120*b* if a force is applied to supply hopper 146 that would tend to lift the supply hopper away from support track 120, such as due to a strong wind, abrupt acceleration or deceleration, or the like.

Figure 7:
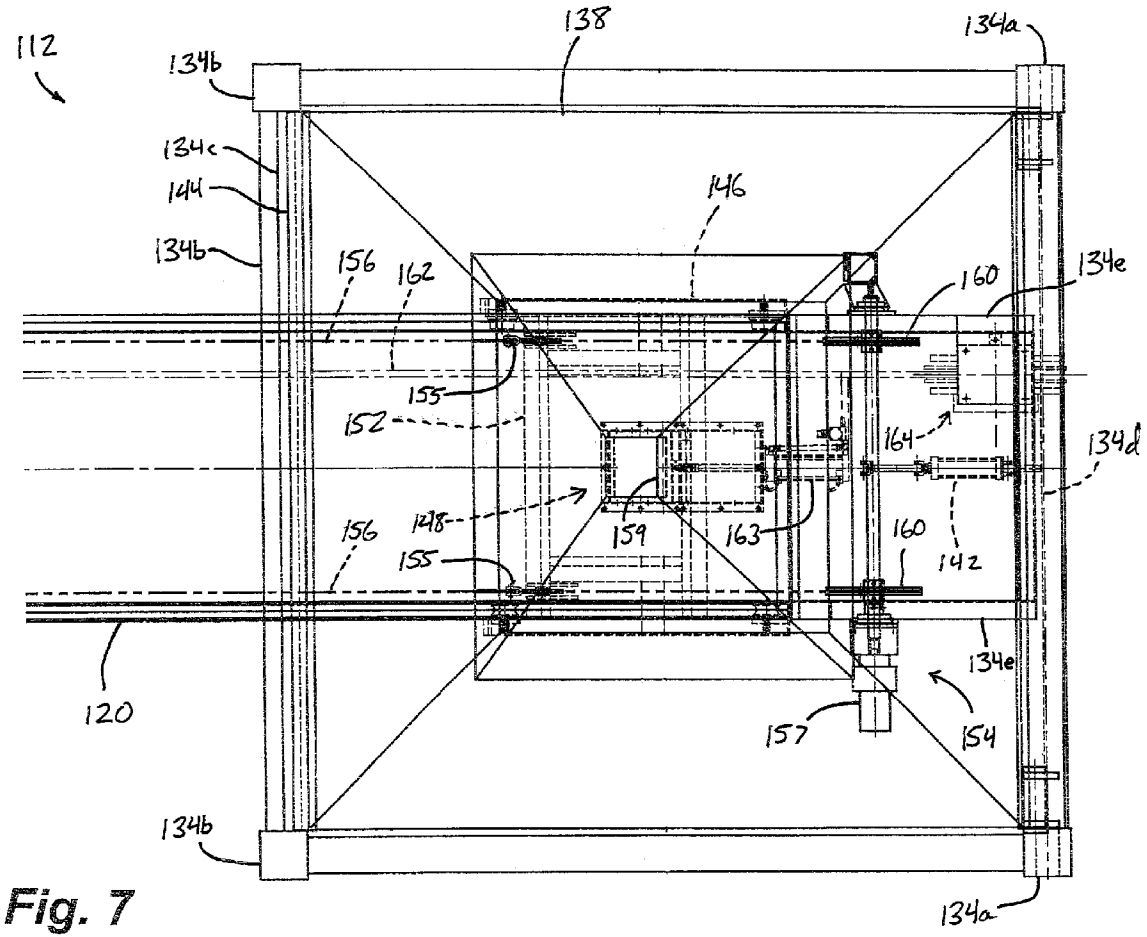
FIG. 7 is an enlarged view of the area designated VII in FIG. 5.

Sand-loading station 112 includes a drive mechanism 154 in the form of a cable winch at a lower end portion 120*c* of first support track 120 (FIG. 6). Drive mechanism 154 is operable to wind and unwind cables 156 that extend along first support track 120, reverse direction at a pulley system 158 located at an upper end portion 120*d* of first support track 120 (FIG. 4), and which are coupled to carriage 152 via respective shackles 155 (FIG. 7). A separate pulley 153 may be provided on carriage 152 for routing cables 156. Drive mechanism 154 includes a pair of pulleys or sheaves 160 on which cables 156 are wound (FIGS. 6 and 7). Drive mechanism 154 further includes a motor 157 (FIG. 7) for rotatably driving pulleys 160, to wind cables 156 onto the respective pulleys 160, which draws supply hopper 146 upwardly along first support track 120, toward upper end portion 120*d*. When supply hopper 146 is to be moved back down to lower end portion 120*e* of support track 120, motor 157 rotates pulleys 160 in the opposite direction to unwind cables 156 from their respective pulleys, thus allowing gravity to move supply hopper 146 back down along support track 120 until the supply hopper reaches lower portion 120*c*.

Dispensing portion 148 of supply hopper 146 includes a movable slide gate 159 that is actuatable via a double-acting cylinder or linear actuator 163 (FIG. 7), which may be a pneumatically or hydraulically-actuated cylinder, for example, that operates in response to pressurized fluid (e.g. air or hydraulic fluid) to open and close the slide gate 159 so that bulk material can be selectively dispensed through a spout 161 at dispensing portion 148. Dispensing portion 148 may be supplied with pressurized fluid via a flexible hose or conduit 162 that is selectively wound and unwound from a hose reel 164 (FIGS. 6 and 7). Hose reel 164 is rotatably mounted to a frame member 165 that is coupled to lower end portion 120*c* of first support track 120, which also supports drive mechanism 154. Hose reel 164 may incorporate a spring return mechanism so that hose reel 164 always applies tension to hose 162, and so that hose 162 automatically winds and unwinds on hose reel 164 with the actuation of drive mechanism 154 to move supply hopper 146 between its lowered and raised positions. Optionally, hose reel 164 may utilize a motorized drive system that can rotate hose reel 164 in opposite directions to wind and unwind hose 162 simultaneously with the actuation of drive mechanism 154. Thus, hose 162 may be coupled between the cylinder 163 at the dispensing portion 148 of supply hopper 146 and a pressurized fluid source, so that slide gate 159 may be actuated when supply hopper 146 is at the raised position corresponding to upper end portion 120*d* of first support track 120.

As best shown in FIG. 6, the open mouth at upper end portion 146*a* of supply hopper 146 is spaced a short distance below lower end portion 138*b* of pivotable funnel 138, which minimizes dust and/or spillage of sand that is poured through funnel 138 and into supply hopper 146. However, if funnel 138 were left in its lower position, as shown in solid lines in FIGS. 4 and 6, funnel 138 would prevent the supply hopper 146 from moving upwardly along first support track 120. By extending actuator 142, pivotable funnel 138 is moved to its raised position (shown in dashed lines in FIGS. 4 and 6) to provide adequate clearance between lower portion 138*b* of funnel 138 and upper end portion 146*a* of supply hopper 146 as the supply hopper is drawn upwardly along first support track 120 by drive mechanism 154.

With both supply hopper 146 and pivotable funnel 138 in their respective lowered positions, an operator may dump bulk sand into supply hopper 146 via funnel 138, using a conventional front-end loader, a belt or paddle conveyor, or the like. Upper portion 138*a* of pivotable funnel 138 is sufficiently large so that sand may be dumped into the funnel 138 from substantially any size bucket of a front end loader or the like, substantially without spilling sand over the sides of the funnel.

As best shown in FIGS. 4 and 5, upper end portion 120*d* of first support track 120 is supported at upper end portion 126*a* of framework 126 so that supply hopper 146 is positioned above container-filling hopper 130 when supply hopper 146 is at upper portion 120*d* of first support track 120. Hose reel 164 is also rotatably coupled to frame member 165, which is in turn coupled to lower end portion 120*c* of support track 120. A ground-contacting frame member or support leg 167 (FIG. 6) is provided at lower end portion 120*c* of first support track 120, to support a portion of the weight of first support track 120 and drive mechanism 154.

Thus, supply hopper 146 may be filled with bulk sand (or other bulk material) at lower portion 120*c* of first support track 120, and then moved to upper portion 120*d* of first support track 120 once funnel 138 is pivoted up out of the way. All (or a portion) of the bulk sand may then be dispensed into container-filling hopper 130 at the upper end of framework 126, of the container-filling station 118. Supply hopper 146 may then be lowered for reloading via pivotable funnel 138, which pivots upwardly to a raised position to provide clearance for supply hopper 146 when the supply hopper is being moved along first support track 120 in the vicinity of lower portion 120*c*.

Optionally, an interlock system or mechanism 169 prevents the supply hopper 146 from moving out of its lower position at lower end 120*c* of first support track 120 if pivotable funnel 138 is in its lowered position. In the illustrated embodiment, interlock system 169 includes a supply hopper sensor 169*a* that detects when supply hopper 146 is at its lowered position, and an actuator sensor 169*b* that detects the position of actuator 142 (FIG. 6). Once funnel 138 is moved to its raised position to provide clearance for the movement of supply hopper 146, the actuator sensor 169*b* sends a signal to drive mechanism 154 that it is safe to raise supply hopper 146, so that interlock system 169 allows supply hopper 146 to move along track 120. Optionally, interlock system 169 may automatically raise funnel 138 to its raised position, prior to activating drive mechanism 154 to raise supply hopper 146 out of its lower position at lower portion 120*c* of first support track 120. Similarly, the interlock system 169 may ensure that funnel 138 is in its raised position when supply hopper sensor 169*a* detects that supply hopper 146 is not at its lowered position, before drive mechanism 154 is permitted to move supply hopper 146 downward from an elevated or raised position to its lowered position. Interlock system 169 may further require that supply hopper sensor 169*a* detect the presence of supply hopper 146 before actuator 142 is permitted to lower funnel 138.

Aggregate-loading station 114 may be substantially identical to sand-loading station 112, such that its components and operation may be fully understood with reference to the above description pertaining to sand-loading station 112 and first support track 120. Like sand-loading station 112, aggregate-loading station 114 includes a pivotable funnel 166 coupled to framework 136, an actuator 168 for pivoting funnel 166, and a movable supply hopper 170 that is repositionable between an elevated position (shown in dashed lines in FIG. 4) at an upper portion 122*d* of second support track 122, and a lower position (shown in solid lines) at a lower portion 122*c* of second support track 122. Aggregate-loading station 114 further includes a drive mechanism 172 that is operable to raise and lower supply hopper 170 via cables 174 in substantially the same manner that drive mechanism 154 operates. A hose reel 176 allows for extending and retracting a flexible hose or conduit as supply hopper 170 moves along second support track 122. It will be appreciated that, while aggregate-loading station 114 is described as being used to convey aggregate or gravel in supply hopper 170, substantially any bulk material may be conveyed using aggregate-loading station 114, or sand-loading station 112, without departing from the spirit and scope of present invention.

Figure 11:
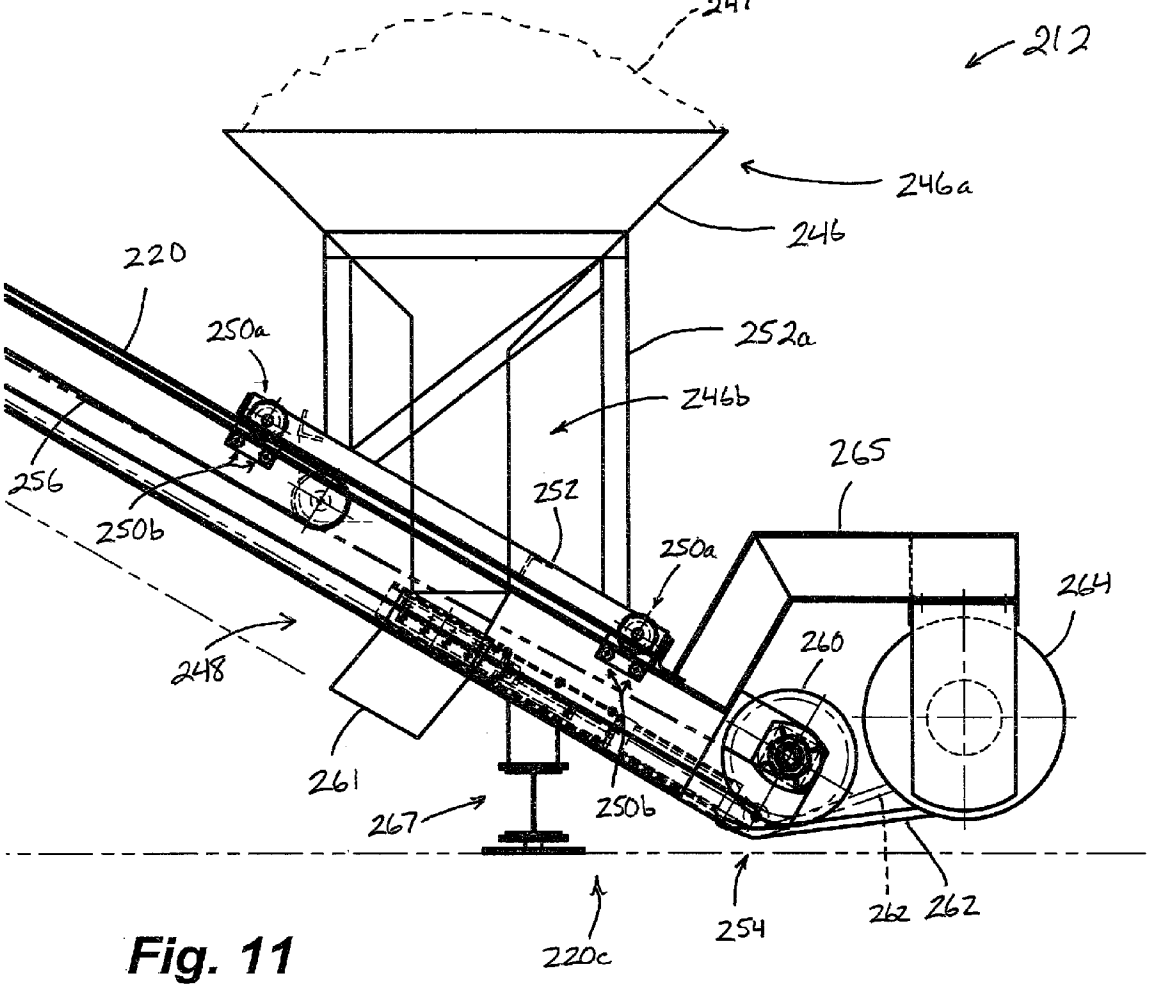
FIG. 11 is an enlarged view of an alternative movable supply hopper for use with the filling machine of FIG. 4.

Optionally, and with reference to FIG. 11, an alternative sand-loading station 212 includes a supply hopper 246 that is sized and structurally supported by a carriage 252 having an upper frame portion 252*a* so that sand or other bulk materials can be dumped or dispensed directly into an open mouth defined by an upper end portion 246*a* of supply hopper. Thus, supply hopper 246 may be filled and moved along a support track 220 without need for a separate funnel used to direct bulk materials from a loader into the supply hopper 246. As shown in FIG. 11, upper end portion 246*a* is capable of supporting bulk material 247 that may be heaped above the upper edge of upper end portion 246*a*. Similar to supply hopper 146, described above, alternative supply hopper 246 includes a lower end portion 146*b* defining a spout 261 for selectively dispensing bulk material from the supply hopper 246. Lower end portion 246*b* further includes a dispensing portion 248 including a movable slide gate for controlling the flow of bulk material through spout 261. Carriage 252 may be movably mounted to support track 220, which is substantially identical to first support track 120, in substantially the same manner as carriage 152 of supply hopper 146.

Carriage 252 includes wheels 250*a*, 250*b*, while a drive mechanism 254 includes cables 256 and pulleys 260 that wind and unwind cables 256, and a hose reel 264 rotatably coupled to a frame member 265 coupled to a lower end portion 220*c* of support track 220. Hose reel 264 is provided for winding and unwinding pneumatic or hydraulic hose 262, which is used to operate the movable slide gate or valve of dispensing portion 248. An adjustable-height ground-contacting frame member or support leg 267 is provided at lower end portion 220*c* of support track 220, to support a portion of the weight of support track 220. It will be appreciated that alternative supply hoppers 246 may be used in place of either or both of supply hoppers 146, 170, without departing from the spirit and scope of the present invention.

Supply hopper 246 (and supply hoppers 138, 170) may be sufficiently large to contain enough bulk materials to supply multiple bags or containers 196 with bulk materials, so that supply hopper 246 does not need to traverse support track 220 for re-filling each time a new bag is to be filled. For example, supply hopper 246 may hold approximately 3½ loads of bulk materials, to ensure that at least three bags 196 can be filled before supply hopper 246 is returned to its lowered position for re-filling. As described above, the upper portion 246*a* of supply hopper 246 may be somewhat larger than that of supply hoppers 138, 170, to facilitate loading of hopper 246 without need for a separate funnel, and so that the capacities of these hoppers are approximately the same, even though supply hopper 246 has a lower portion 246*b* that may be lower in volume than that of supply hoppers 137, 170. The un-filled weight of supply hopper 246 may also be approximately the same as that of supply hoppers 138, 170. The sloped funnel shape of supply hopper 246 helps to ensure that all of the bulk materials are channeled or directed into the supply hopper's lower portion 246*b* from its upper portion 246*a*.

Figure 8:
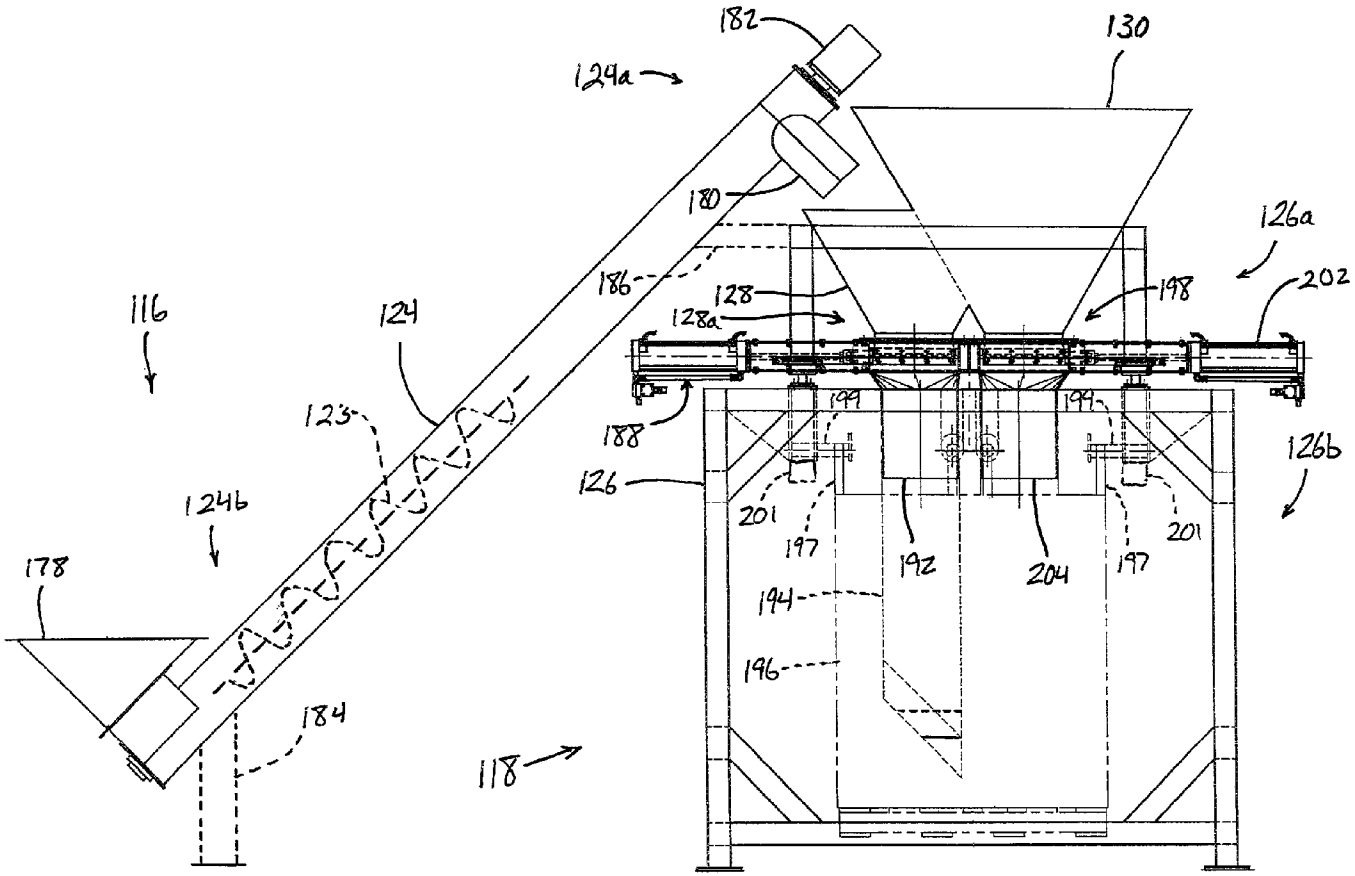
FIG. 8 is an end elevation of a portion of the filling machine of FIG. 4, taken along line VIII-VIII in FIG. 5, with other portions of the filling machine removed for clarity.
Figure 9:
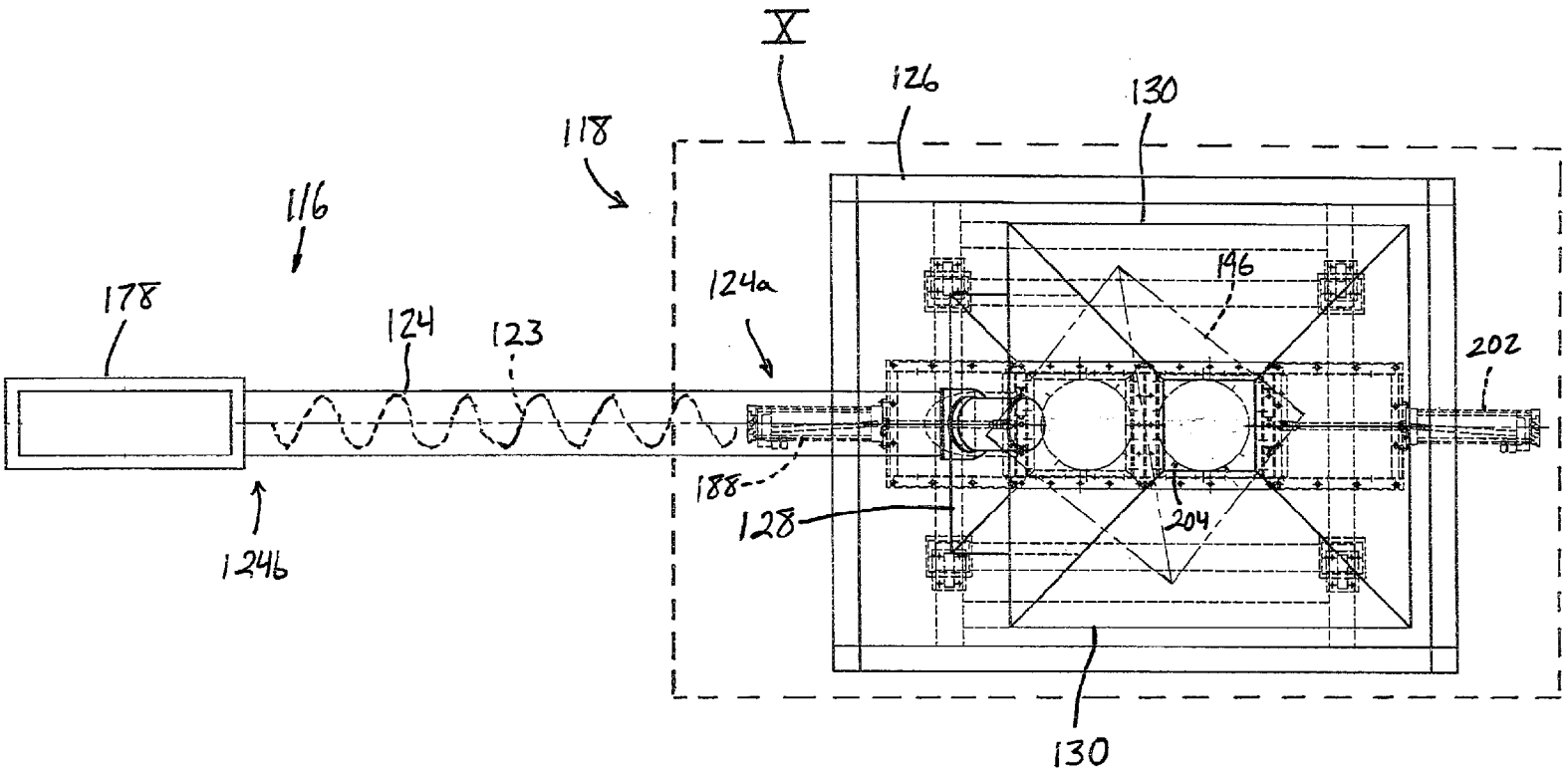
FIG. 9 is a top plan view of the portion of the filling machine of FIG. 8.

Cement-loading station 116 includes a load hopper 178 at a lower end portion 124*b* of screw conveyor 124, and a dispensing spout 180 and drive motor 182 at an upper end portion 124*a* (FIGS. 8 and 9). Screw conveyor 124 is angled so that lower end portion 124*b* is positioned near a ground or support surface, and an upper portion 124*a* is at an elevated location so that dispensing spout 180 is above cement-dispensing hopper 128 (FIG. 8). Drive motor 182 is an electrical, hydraulic, or pneumatic motor capable of rotating a screw or auger 123 (FIGS. 8 and 9) that extends substantially the full length of screw conveyor 124, from load hopper 178 to dispensing spout 180, and is supported on suitable bearings at each end of the screw or auger, whereby rotation of the screw by drive motor 182 drives cement powder from load hopper 178 and conveys it along the screw conveyor. Screw conveyor 124 may be supported at its lower end portion 124*b* by a support leg 184, and may be supported at its upper end portion 124*a* by a frame member 186 coupled to upper end portion 126*a* of framework 126.

Figure 10:
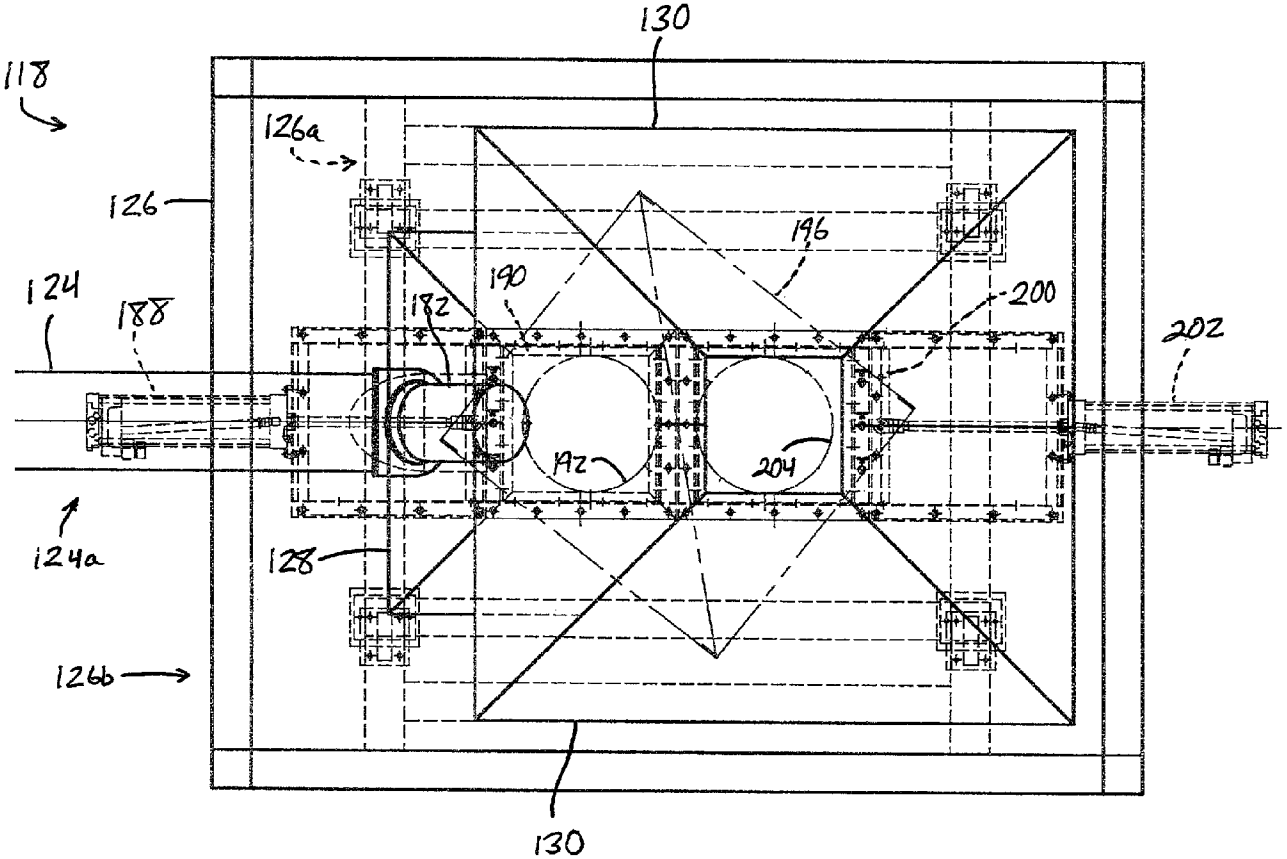
FIG. 10 is an enlarged view of the area designated X in FIG. 9.

Optionally, container-filling station 118 includes a double-acting actuator 188 coupled to upper end portion 126*a* of framework 126, actuator 188 being operable to move a slide gate 190 at a lower dispensing portion 128*a* of cement-dispensing hopper 128 (FIGS. 8-10). Lower dispensing portion 128*a* of cement-dispensing hopper 128 includes a spout 192 in fluid communication with cement-dispensing hopper 128. Spout 192 is sized and shaped to be inserted into a liner 194 of a multi-chamber container or bag 196, as best shown in FIG. 8. Container-filling station 118 may also include a bag conveyor, substantially similar to conveyor 20, described above, for receiving and transporting filled containers 196 away from container-filling station 118.

Container-filling hopper 130 may be configured substantially similarly to cement-dispensing hopper 128, including a lower dispensing portion 198 having a slide gate 200 (FIG. 10) that is actuatable between open and closed positions by a double-acting actuator 202. Lower dispensing portion 198 includes a discharge spout 204 in fluid communication with container-filling hopper 130, as best shown in FIGS. 9 and 10, so that container-filling hopper 130 discharges through spout 204 when slide gate 200 is opened by actuator 202. However, it will be appreciated that screw conveyor 124 and the respective dispensing portions of supply hoppers 146, 170 are capable of selectively dispensing cement binder, sand, aggregate, or other bulk materials at controllable rates, such that container-filling hopper 130 and cement-dispensing hopper 128 may be left open at their respective lower dispensing portions 128*a*, 198, or their respective slide gates may be omitted entirely, while still permitting bulk materials to be metered into multi-chamber bags 196, as will be described below.

Accordingly, bag filling machine 110 facilitates the filling of multi-chamber bags 196, using front end loaders or other common bulk material handling equipment to load movable supply hoppers 146, 170, with sand or gravel (or substantially any other desired bulk material) via respective funnels 138, 166. Optionally, supply hoppers 246 may be filled without need for funnels. Each movable supply hopper includes a lower dispensing portion with a slide gate and a spout that allows bulk materials to be dispensed and/or metered out of the respective supply hoppers and into container-filling hopper 130 at the top of container-filling station 118. In the illustrated embodiment, container-filling hopper 130 is provided with a discharge spout 204 that is selectively opened and closed by slide gate 200 in response to actuator 202, so that bulk sand and gravel may be dispensed from their respective supply hoppers and through container-filling hopper 130. Optionally, separate sand-dispensing and aggregate-dispensing hoppers may be provided, which include respective slide gates and actuators that permit individual metering of sand and gravel into multi-chamber bag 196 via separate discharge spouts. Screw conveyor 124 conveys dry cement binder from a lower position to an elevated position above a cement dispensing hopper 128 at upper end portion 126*a* of framework 126. The screw conveyor itself can provide a metering function, while lower dispensing portion 128*a* of cement dispensing hopper 128 also permits the metering of cement into the liner portion 194 of multi-chamber bag 196.

Because screw conveyor 124 and supply hoppers 146, 170 are capable of metering or dispensing their respective bulk materials at controlled rates, slide gates 190, 200 may be left open, or may be omitted entirely from the container-filling station 118. For example, and with reference to FIG. 8, multi-chamber bag 196 may be provided with support straps 197 that are slung over respective support arms 199, which are equipped with load-measuring devices 201 that measure the weight of bag 196 and its contents as the bag 196 is filled. With spouts 192, 204 left open during the dispensing of bulk materials from screw conveyor 124 and supply hoppers 146, 170, load-measuring devices 201 constantly measure the weight of bag 196 and its contents. This allows monitoring and controlling the quantity of each bulk material that has been added to bag 196, as long as the bulk materials are added sequentially.

For example, gravel or aggregate may first be dispensed from supply hopper 170 to bag 196 via container-filling hopper 130 and spout 204, until load-measuring devices 201 determine that a desired amount of gravel or aggregate has been added to bag 196, at which point the slide-gate at the lower dispensing portion of supply hopper 170 is closed. Then sand may be added to bag 196 from supply hopper 146, via container-filling hopper 130 and spout 204, until load-measuring devices 201 determine that a desired amount of sand has been added, such as by subtracting the bag weight prior to the addition of sand from the bag weight after the addition of sand, at which point the slide-gate 159 of supply hopper 146 is closed. In much the same manner, screw conveyor 124 may be operated by rotatably driving auger 123 with motor 182, until load-measuring devices 201 determine that a desired amount of cement binder has been added to liner 194 of bag, via cement-dispensing hopper 128 and spout 194, at which point the motor 182 and auger 123 are stopped.

Filling machine 110 includes a data recorder and controller 58' (FIG. 4) for controlling the operation of the filling machine 110, and for recording data about the contents of each container 196. For example, data recorder and controller 58' may be configured to control the actuators 142, 168 to raise and lower the respective funnels 138, 166, and may control the drive mechanisms 154 to raise and lower supply hoppers 146, 170 and to control the slide gates at their respective lower dispensing portions. Controller 58' may also be in communication with interlock system 169 so that funnels 138, 166 are positioned appropriately when supply hoppers 146, 170 are to be moved between their raised and lowered positions. Controller 58' may be used to control screw conveyor 124 and the slide gates 190, 200 of hoppers 129, 130, may be in communication with load measuring devices 201 of support arms 199, and may operate substantially all functions of the sand-loading station 112, the aggregate-loading station 114, the cement-loading station 116, and the container-filling station 118 in response to user-input parameters such as bag fill weight, and the ratios of sand to gravel to cement binder (or other bulk materials). Data recorder and controller 58' may receive data pertaining to the contents of each container 196, including the amount and/or ratio of each bulk material that has been added to each container, and the container's final weight as reported by the load measuring devices. Data recorder and controller 58' may be substantially similar to data recorder and controller 58, described above.

Thus, the present invention provides an apparatus and method for filling multi-chamber containers with at least two different bulk materials that remain separated during handling on the apparatus, during dispensing into the chambers of the containers, and in the containers themselves. The machine includes elevated hoppers for receiving and storing the bulk materials prior to dispensing into the multi-chamber containers, actuatable members for controlling and/or metering the flow of bulk materials into the containers, and a conveyor system for transporting the filled containers away from the filling region or station. The machine and method may be particularly well-suited for handling different bulk materials when at least one of the bulk materials is sensitive to moisture, chemicals or contaminants, or being dispersed by wind, such as by utilizing a pneumatic tube for conveying the sensitive bulk material in fluidized form, and directing the bulk material into a covered hopper. The apparatus may further include a controller and/or data recorder for controlling the function of the apparatus and for recording the contents and/or weight of each filled container.

Changes and modifications in the specifically described embodiments may be carried out without departing from the principles of the present invention, which is intended to be limited only by the scope of the appended claims, as interpreted according to the principles of patent law including the doctrine of equivalents.

The invention claimed is:

1. A filling machine for filling multi-chamber containers with two or more different bulk materials, said machine comprising:

a frame;

first and second container-filling hoppers supported at said frame and configured to direct a first bulk material and a second bulk material, respectively, into a multi-chamber container, the second bulk material being different in composition than the first bulk material, wherein said first container-filling hopper is in fluid communication with a corresponding first dispensing portion and said second container-filling hopper is in fluid communication with a corresponding second dispensing portion, said first and second dispensing portions configured to dispense the first and second bulk materials from said first and second container-filling hoppers, respectively;

a first supply hopper configured to contain the second bulk material, said first supply hopper having a dispensing portion for selectively dispensing the second bulk material;

a first support track for movably supporting said first supply hopper, said first support track having a first end portion spaced laterally away from said second container-filling hopper, and a second end portion positioned near said second container-filling hopper; and a first drive mechanism associated with said first support track and configured to move said first supply hopper between said first and second end portions of said first support track;

wherein said first container-filling hopper is configured to dispense the first bulk material into a first chamber of the multi-chamber container via said first dispensing portion and said second container-filling hopper is configured to dispense the second bulk material into a second chamber of the multi-chamber container via said second dispensing portion.

2. The filling machine of claim 1, wherein at least one of said first and second dispensing portions comprises an actuatable member configured to selectively permit at least one of the first and second bulk materials to be dispensed through said at least one of said first and second dispensing portions.

3. The filling machine of claim 2, wherein said actuatable member comprises a pneumatic slide-gate.

4. The filling machine of claim 2, wherein said actuatable member comprises a measurement device, said measurement device configured to measure the quantity of the first or second bulk materials as the first or second bulk materials are dispensed through said at least one of said first and second dispensing portions.

5. The filling machine of claim 4, further comprising a data recorder for recording the quantity of at least one of the first and second bulk materials that have been dispensed into at least one of the multi-chamber containers.

6. The filling machine of claim 5, wherein said data recorder comprises a printer configured to create a written record of the quantity of the at least one of the first and second bulk materials that have been dispensed into at least one of the multi-chamber containers.

7. The filling machine of claim 1, wherein the first bulk material comprises a cement binder and the second bulk material comprises a mixture of sand and aggregate.

8. The filling machine of claim 1, wherein said first end portion of said first support track is positioned at an elevation below that of said second container-filling hopper.

9. The filling machine of claim 1, further comprising at least one chosen from a screw conveyor and a pneumatic tube configured to convey the first bulk material to said first container-filling hopper using air.

10. The filling machine of claim 9, wherein said filling machine comprises said pneumatic tube, including an inline ventilation module configured to separate the first bulk material in said pneumatic tube from the air, to vent the air, and to direct the first bulk material into the first container-filling hopper.

11. The filling machine of claim 1, further comprising a conveyor for supporting and transporting one or more of the multi-chamber bulk material containers.

12. The filling machine of claim 1, further comprising at least one support arm configured to suspend the multi-chamber container during dispensing of the first and second bulk materials from the first and second container-filling hoppers into the first and second chambers of the multi-chamber container.

13. The filling machine of claim 12, further comprising a weigh scale at said at least one support arm, said weigh scale configured to measure the weight of the multi-chamber containers when said multi-chamber containers are supported at said at least one support arm.

14. The filling machine of claim 1, further comprising a data recorder for recording the quantity of at least one of the bulk materials that have been dispensed into at least one of the multi-chamber containers.

15. The filling machine of claim 14, wherein said data recorder comprises a printer configured to create written record of at least one of (i) the weight of at least one of the multi-chamber containers and (ii) the quantity of at least one of the bulk materials that have been dispensed into at least one of the multi-chamber containers.

16. The filling machine of claim 1, wherein said first drive mechanism comprises a cable winch.

17. The filling machine of claim 1, further comprising an actuatable member at said dispensing portion of said first supply hopper, said actuatable member configured to selectively permit said second bulk material to be dispensed through said dispensing portion when said first supply hopper is positioned at said second end portion of said first support track.

18. The filling machine of claim 17, wherein said actuatable member is operable in response to a pressurized fluid, said filling machine further comprising:

a pressurized fluid source;

a pressurized fluid hose in fluid communication with said fluid source and said actuatable member;

an extendable and retractable hose reel for supporting at least a portion of said pressurized fluid hose; and wherein said hose reel is operable to extend and retract said pressurized fluid hose as said first supply hopper is moved between said first and second end portions of said first support track by said first drive mechanism.

19. The filling machine of claim 1, further comprising:

a second supply hopper configured to contain a third bulk material, said second supply hopper having a dispensing portion for selectively dispensing the third bulk material;

a second support track for movably supporting said second supply hopper, said second support track having a first end portion spaced laterally away from said third hopper, and a second end portion positioned near said second container-filling hopper; and a second drive mechanism associated with said second support track and configured to move said second supply hopper between said first and second end portions of said second support track.

20. The filling machine of claim 19, wherein the first bulk material comprises a cement binder, the second bulk material comprises sand, and the third bulk material comprises aggregate.

21. The filling machine of claim 1, further comprising a first funnel positioned above said first end portion of said first support track, said first funnel also positioned above said first supply hopper when said first supply hopper is positioned at said first end portion of said first support track, wherein said first funnel is configured to direct the first bulk material from a source into said first supply hopper at said first end portion of said first support track.

22. A filling machine for filling multi-chamber containers with two or more different bulk materials, said machine comprising:

a frame;

first and second container-filling hoppers supported at said frame and configured to contain a first bulk material and a second bulk material, respectively, the second bulk material being different in composition than the first bulk material, wherein said first container-filling hopper is in fluid communication with a corresponding first dispensing portion and said second container-filling hopper is in fluid communication with a corresponding second dispensing portion, said first and second dispensing portions configured to dispense the first and second bulk materials from said first and second container-filling hoppers, respectively;

a first supply hopper configured to contain the second bulk material, said first supply hopper having a dispensing portion for selectively dispensing the second bulk material into said first dispensing portion of said first container-filling hopper;

a first support track for movably supporting said first supply hopper, said first support track having a first end portion spaced laterally away from said first container-filling hopper, and a second end portion positioned above said first container-filling hopper;

a first drive mechanism associated with said first support track and configured to move said first supply hopper between said first and second end portions of said first support track; and wherein said first container-filling hopper is configured to dispense the first bulk material into a first chamber of a multi-chamber container via said first dispensing portion and said second container-filling hopper is configured to dispense the second bulk material into a second chamber of the multi-chamber container via said second dispensing portion.

23. A method of filling multi-chamber containers with two or more different bulk materials, said method comprising:

providing a filling machine having a frame, first and second container-filling hoppers supported at the frame, and a conveyor;

filling the first container-filling hopper with a first bulk material and filling the second container-filling hopper with the second bulk material, wherein said filling the second container-filling hopper with a second bulk material comprises:

providing a movable hopper coupled to a support track having a first end portion and a second end portion;

positioning the first end portion of the support track above the second container-filling hopper;

filling the movable hopper with the second bulk material when the movable hopper is positioned at the second end portion of the support track;

moving the movable hopper to the first end portion of the support track; and dispensing the second bulk material from the movable hopper into the second container-filling hopper;

positioning a multi-chamber container at a filling station of the filling machine;

dispensing a predetermined amount of the first bulk material into a first chamber of the multi-chamber container via a first dispensing portion in fluid communication with the first container-filling hopper;

dispensing a predetermined amount of the second bulk material into a second chamber of a multi-chamber container via a second dispensing portion in fluid communication with the second container-filling hopper; and transporting the multi-chamber container away from the filling station with the conveyor.

24. The method of claim 23, further comprising measuring and recording data indicative of the composition of the contents of the multi-chamber container.

25. The method of claim 24, further comprising measuring and recording data indicative of the weight of the multi-chamber container.

* * * * *

UNITED STATES PATENT AND TRADEMARK OFFICE

CERTIFICATE OF CORRECTION

PATENT NO. : 9,010,382 B2
APPLICATION NO. : 13/599024
DATED : April 21, 2015
INVENTOR(S) : Reinhard Matye It is certified that error appears in the above-identified patent and that said Letters Patent is hereby corrected as shown below:

In the specification
Column 12
Line 56, "120e" should be --120c--

Signed and Sealed this
Seventeenth Day of November, 2015

Michelle K. Lee

Michelle K. Lee
*Director of the United States Patent and Trademark Office*